United States Patent [19]

Anderson

[11] 4,022,504

[45] May 10, 1977

[54] LATCH RECEPTACLE

[75] Inventor: Bruce W. Anderson, Arlington Heights, Ill.

[73] Assignee: Illinois Tool Works Inc., Chicago, Ill.

[22] Filed: Mar. 15, 1976

[21] Appl. No.: 666,821

Related U.S. Application Data

[63] Continuation-in-part of Ser. No. 648,063, Jan. 12, 1976, abandoned.

[52] U.S. Cl. ..... 292/340; 292/17; 292/19; 292/76; 292/DIG. 38

[51] Int. Cl.[2] ..... E05B 15/02

[58] Field of Search ..... 292/17, 19, 70, 76, 292/18, 340, 80, DIG. 38, DIG. 11; 24/208 A, 216, 217 R; 248/56; 339/126 RS, 128; 151/41.75

[56] References Cited

UNITED STATES PATENTS

| | | | |
|---|---|---|---|
| 2,414,662 | 1/1947 | Ostrom | 292/17 |
| 2,833,583 | 5/1958 | Stone et al. | 292/340 |
| 2,847,240 | 8/1958 | Stone et al. | 292/70 |
| 2,933,794 | 4/1960 | Biesecker | 292/DIG. 38 |
| 2,946,612 | 7/1960 | Ahlgren | 292/17 |
| 3,038,747 | 6/1962 | Rapata | 292/17 |
| 3,103,378 | 9/1963 | Ahlgren | 292/17 |
| 3,466,075 | 9/1969 | Fernandez et al. | 292/19 |
| 3,520,568 | 7/1970 | White et al. | 292/340 X |
| 3,768,115 | 10/1973 | Hoffmann et al. | 248/56 X |
| 3,776,580 | 12/1973 | Michael | 292/17 |
| 3,826,206 | 7/1974 | Ruggles | 85/8.8 X |
| 3,846,736 | 11/1974 | Muz | 339/126 RS |

FOREIGN PATENTS OR APPLICATIONS

| | | | |
|---|---|---|---|
| 921,790 | 3/1963 | United Kingdom | 24/216 |
| 1,024,220 | 3/1966 | United Kingdom | 24/208 A |

*Primary Examiner*—Roy D. Frazier
*Assistant Examiner*—Rodney H. Bonck
*Attorney, Agent, or Firm*—Jack R. Halvorsen; Robert W. Beart

[57] ABSTRACT

A one-piece plastic latch receptacle mounted in an apertured panel and adapted to accept a shouldered strike. The latch includes a resilient oval tubular portion supported in spaced independently flexible relation to both the head and mounting legs and carries at least one shouldered rib positioned along each major dimension of the oval for engagement of the strike at a plurality of positions.

9 Claims, 9 Drawing Figures

LATCH RECEPTACLE

This is a continuation-in-part of application Ser. No. 648,063, filed Jan. 12, 1976, and now abandoned.

BACKGROUND OF THE INVENTION

The use of plastic latches or catches is well known in the art for the purpose of securing one moveable member relative to a fixed member; and more particularly, the use of a latch or receptacle especially suitable for receiving and releasably retaining a strike pin mounted on a cabinet door or the like. A common problem in all of such latch devices is the problem of alignment of the latch with the strike pin. Deviations in manufacturing tolerances must be accepted in order for such latches to operate in an acceptable manner. Examples of the prior art can be found in the following United States patents, namely, U.S. Pat. Nos. 2,847,240; 3,038,747; and 3,103,378. While attempts are made in each of these devices to overcome the problem of misalignment of the latch relative to the strike pin, there have been inherent difficulties incurred in the field which demand a better solution.

Brief Summary of the Invention

The present invention relates to a one-piece plastic latch in which the latch is capable of movement along one axis within a panel aperture and provides a plurality of positions along a second axis perpendicular to the first axis in which the strike pin can be readily accepted as well as providing a minimum angular disorientation of the strike from its intended location and still be workable. The solution to these problems in accomplished by permitting "float" of the latch within a panel aperture along one axis while providing an oval resilient tubular member having its major axis disposed perpendicular to the first axis and having a plurality of shoulder means spaced along said major axis for retention of the strike pin at a related number of positions.

A further object of the present invention is to provide an economical device capable of quick assembly with an aperture panel and adjustable within limits to overcome the deficiencies of the prior art.

Further object and mechanical equivalent will be apparent to those skilled in the art.

DETAILED DESCRIPTION OF THE INVENTION

Figure 1:
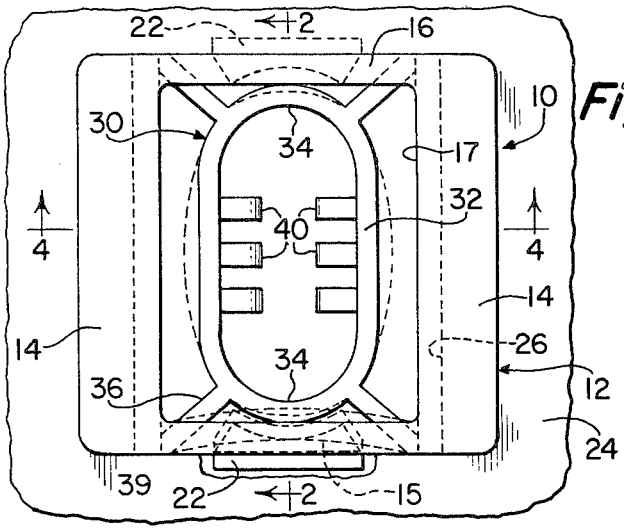
FIG. 1 is a plan view showing an embodiment of the present invention in installed position in an apertured panel.
Figure 2:
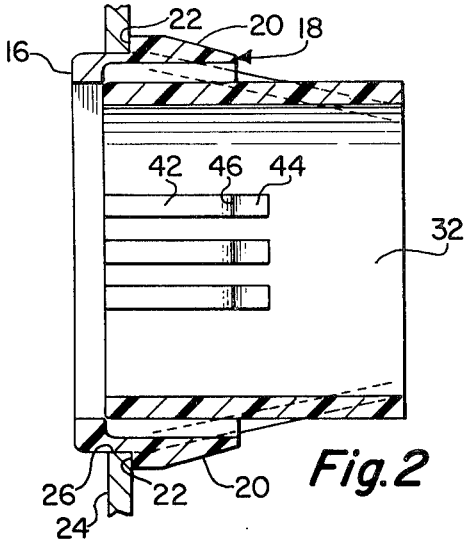
FIG. 2 is a side elevation in partial section taken alone line 2—2 of FIG. 1.
Figure 3:
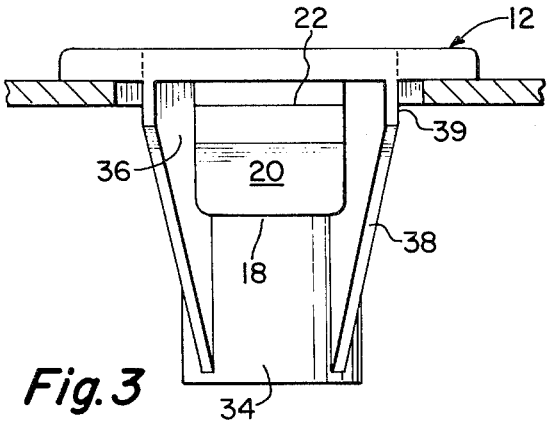
FIG. 3 is an end elevational view in partial section of the embodiment shown in FIG. 1.
Figure 4:
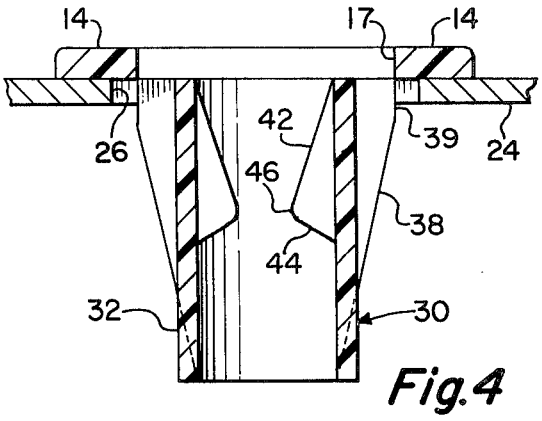
FIG. 4 is an elevational view in partial section taken along line 4—4 of FIG. 1.

Referring now to the drawings wherein similar parts are designated by similar numerals, a latch 10 of the type contemplated by the present invention includes a generally rectangular open head 12 having two substantially rigid parallel elements 14 at opposite ends thereof interconnected by two flexible members 16. Depending from each of the members 16 is a leg 18 having a tapered lead-in portion 20 terminating in a shoulder 22 facing in opposed relation to the head 12. The head and legs 18 are adapted to fasten the latch into a panel 24 having a generally rectangular or square aperture 26.

An open ended generally resilient oval tubular member 30 is positioned substantially co-axially with the opening 17 in the head 12. It is spaced from the head and the legs 8 and includes a pair of generally parallel elongated sides 32 interconnected by curved ends 34. The tubular member 30 is maintained in this position by a plurality of support means 36 taking the form of an angularly disposed flange connected to the tubular member adjacent the juncture of the flat sides 32 and the curved ends 34. The flanges 36 are connected throughout a substantial portion of the axial extent of tubular member 30 and have the outer surface thereof divergingly tapered as at 38 to a juncture with an axially disposed portion 39 which serves as an abutment means for defining the limits of lateral movement of the latch within the aperture 26 in the present embodiment four such flanges 36 are provided.

Internally of the tubular member 30 there are a plurality of integral ribs 40 which are generally axially disposed in laterally spaced relation to one another and extend into the bore of the tubular member 30 from the opposed sides 32. Each rib 40 includes a lead-in portion 42 which converges inwardly from the head end towards the axis and then is provided with an abrupt taper 44 in the opposite direction forming a shoulder 46. In this embodiment the ribs are shown as being disposed opposite to one another as they extend in from the sides 32; but, of course, alternate arrangements or number of ribs can be utilized.

In the use of such a latch, the latch is telescoped into aperture 26 in panel 24 by introducing the tubular element 30 until the walls of aperture 26 contact the tapered portion 38 of ribs 36. The tapered portion serves as a lead-in to locate latch 10. Further axial movement into the aperture brings the tapered cam surface 20 of legs 18 into contact with the opposed side walls of the aperture. The legs 18 have a compound action in that the free end of legs 18 will bend inwardly toward the tubular member 30; and the flexible member 16 in the head will also bend inwardly, as shown by dotted line 15 in FIG. 1, to permit the thickest portion of leg 18 to pass through the aperture and to then spring outwardly when the shoulder 22 passes and engages the opposite side of panel 24 from the side engaged by head 12. Thus, the latch if captured in the panel 24 between the head 12 and shoulder 22.

Figure 5:
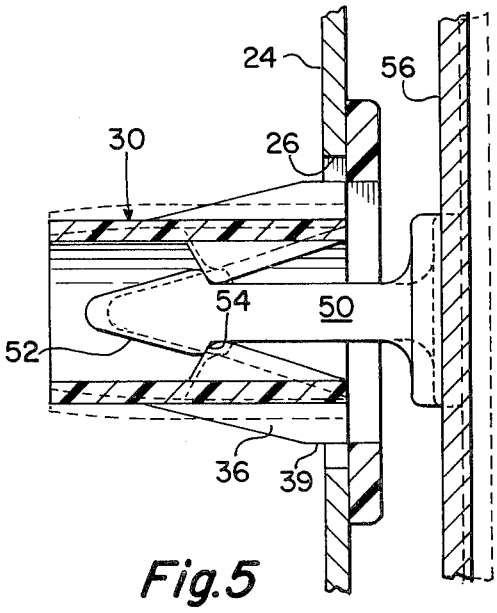
FIG. 5 is an end elevational view in partial section showing the embodiment of the present invention as it cooperates with a strike pin.
Figure 6:
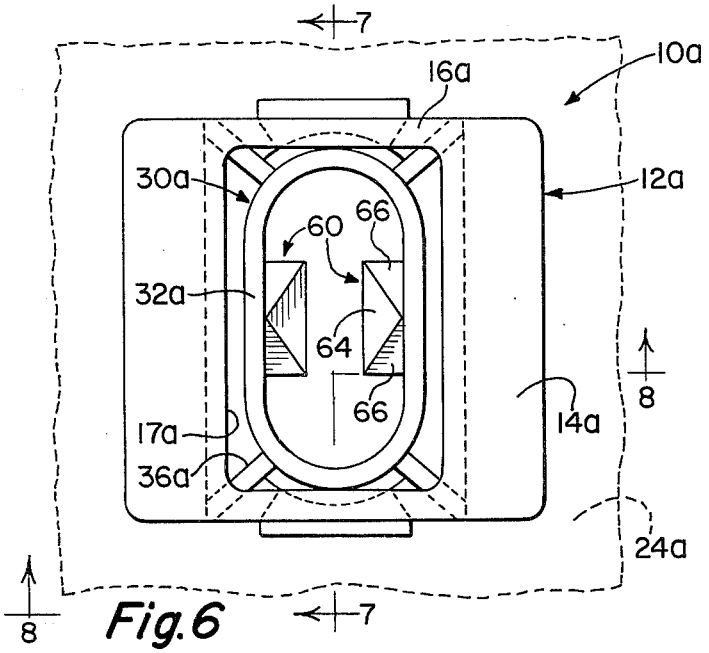
FIG. 6 is a plan view of a second embodiment of the present invention showing it in installed position in an apertured panel.
Figure 7:
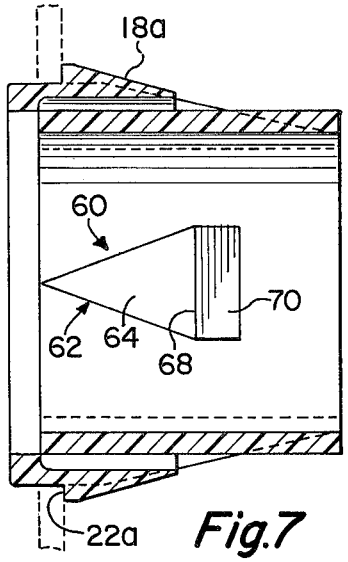
FIG. 7 is a side elevation in partial section taken along line 7—7 of FIG. 6.
Figure 8:
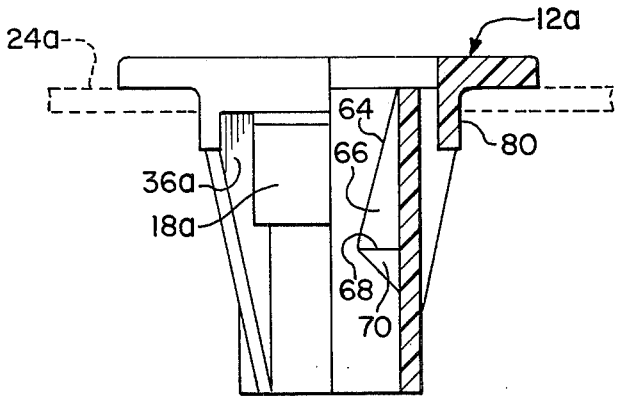
FIG. 8 is an end elevational view in partial section taken along line 8—8 of FIG. 6.
Figure 9:
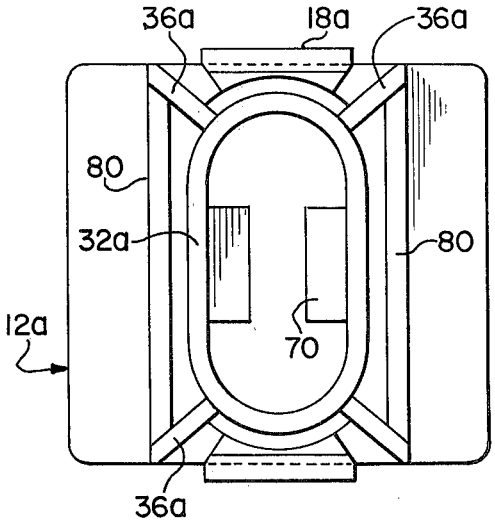
FIG. 9 is a bottom end view.

A latch of this type is generally adapted for use with a strike pin 50, well known in the art, having a tapered entering portion 52 and an intermediate abrupt shoulder 54 suitable mounted on a panel or door 56 which is to be releasably retained relative to the panel 24. As the free end 52 of the strike 50 is introduced into the tubular element, it will contact one or more pairs of opposed ribs 40. Continued penetration results in a lateral distortion, as shown in phantom in FIG. 1 and FIG. 5, of the oval tubular member 30. Where the strike has limited transverse thickness, it will result in acceptability within the oval member 30 over a wide range of positions. The aperture 26 generally has a dimension greater than the spacing of flat portions 39 of flange 36 to permit float along the horizontal axis, as seen in FIG. 1; while the oval tubular member permits a wide acceptance of tolerance in the placement of the strike pin, as viewed in the vertical axis of FIG. 1. Additionally, the angularly disposed flanges 36 are capable of torsional movement to assist in displacement of the tubular member 30 during axial insertion of the strike pin 50.

Referring now to a modification as shown in FIGS. 6–9, wherein similar parts are identified by similar numerals with the addition of the suffix *a*, the latch 10*a* includes an open head 12*a* having rigid portions 14*a* and flexible portions 16*a* carrying legs 18*a* positioned coaxially with head aperture 17*a* is an open-ended oval tubular member 30*a* from head 12*a* by a plurality of axially extending flanges 36*a*, all elements functioning substantially in the same fashion when mounted in apertured panel 24*a* (shown in phantom), as their counterparts in the embodiment hereinbefore disclosed.

The main modification in this embodiment is directed to the inwardly directed shoulder means. In this embodiment there is a single inwardly directed rib 60 extending integrally from each elongated side wall 32*a* in opposed relation. Each rib 60 includes a semi-pyramidal portion 62 which includes a front surface 64 that commences with a point on side wall 32*a* adjacent head 12*a* and tapers inwardly into said bore 17*a* and includes tapered side surfaces 66, all of which terminate in a common plane 68 defined by their juncture with the wedge-shaped reversely tapered portion 70. This forms the shoulder 68 normally engaged by a strike of the type designated by the numeral 50 in the first embodiment, but not shown here.

The semi-pyramidal portion 62 with its limited area of contact with the side wall 32*a* permits maximum flexibility in wall 32*b* adjacent the open end or entryway adjacent head aperture 17*b*. The tapered front surface 64, as well as side surfaces 66, guide either an aligned or misaligned strike 50 into engagement with shoulder 68.

This embodiment also includes a reinforcing flange 80 which is integral and co-extensive with each of the rigid portions 14*a* of head 12*a*. The flange 80 connects flanges 36*a* at opposite ends of the head and extends axially from head 12*a* a distance substantially equal to portion 39 in the previous embodiment. Thus, flanges 80 serve the multiple function of rigidifying element 14*a* of head 12*a*; increasing the stiffness of support means 36*a* when subjected to torsional forces as tubular member 30*a* is flexed; and serve as a locating means within the aperture of panel 24*a*.

Thus, the present invention overcomes most of the problems of the prior art in that it provides effective retention means by independent legs 18 and head 12; and independently acting latching portion or tubular member 30 which will not become over stressed due to its independent action and will not affect the retention of the latch shoulders 22 in the panel 24. The present device can be readily molded by conventional two-plate injection molding techniques from standard thermo plastic materials such as nylon or acetal. Variations in materials and side as well as minor mechanical equivalents will be apparent to those skilled in the art.

I claim:

1. A one-piece plastic latch adapted to project through and be axially telescoped into and mounted in an opening in a panel and adapted to receive in said latch a projecting strike, said latch including an apertured head, a pair of spaced retaining legs extending axially from said head, said legs each having engaging means spaced from and in opposition to the head for engaging the panel, an oval axially disposed resilient tubular means located between and in spaced relation to said legs and spaced from said head and having an open oval bore positioned in alignment with said head aperture, said tubular means being supported in spaced relation to said head and legs by one or more spaced support means located at each of the opposite end walls of said oval tubular means, spaced means positioned within said tubular means for impinging on the strike when it projects through said head aperture into said tubular means, said tubular means being substantially flat along its elongated side walls which are interconnected by curved end walls, said support means including axially extending flanges which are angularly disposed relative to the long axis of said oval with at least one flange extending outwardly from adjacent an axial line on each of the curved end walls where each said curved end wall meets one of said elongated side walls, the end of said flanges having a limited connection to said head whereby said flanges can absorb a tortional stress at said connection thereby permitting deformation of said tubular member at its curved end walls as well as its elongated side walls during insertion of said strike, but said flanges maintaining the tubular means in relatively fixed spaced relation to said head and said legs.

2. A plastic latch of the type claimed in claim 1 wherein said spaced means positioned within said tubular means includes at least one axially disposed rib extending into said oval bore from each opposed elongated wall of said tubular means.

3. A plastic latch of the type claimed in claim 2 wherein each of said ribs taper outwardly from their juncture with the wall of said bore adjacent said head to a point spaced from said head where they taper inwardly toward said wall to form shoulder means for resiliently engaging said strike.

4. A plastic latch of the type claimed in claim 3 wherein there are a plurality of transversely spaced ribs disposed on each elongated side wall forming said bore whereby said strike is afforded a plurality of positions within the resilient oval bore at which it can be accommodated.

5. A plastic latch of the type claimed in claim 3 wherein said portion of the rib which tapers out from the side wall presents a first surface having edges which diverge from each other in the direction from the juncture with the side wall towards said shoulder means.

6. A plastic latch of the type claimed in claim 5 wherein said first surface is generally triangular in shape and is joined to the tubular side wall by tapered sloping second surfaces, said first and second surfaces forming a substantially semi-pyramidal configuration on the rib down to said shoulder means.

7. A plastic latch of the type claimed in claim 1 wherein the free longitudinal edge of each of said flanges is tapered outwardly in a direction away from the free end of said latch entering the apertured panel to a point spaced from the head and then extends parallel to the axis of the latch up to the head to provide a bearing surface and locating means for positioning the latch in the panel aperture.

8. A plastic latch of the type claimed in claim 1 wherein said axially extending flanges are four in number and are angularly disposed relative to the latch axis with two flanges extending outwardly from adjacent the juncture of each of the curved end walls with said elongated side walls.

9. A plastic latch of the type claimed in claim 8 wherein said legs are each positioned between adjacent pairs of flanges located at opposite ends of said oval tubular means, said legs engaging means including a tapered lead-in and a intermediate shoulder means, said shoulder means extending laterally beyond said locating means whereby said latch is capable of limited float within the panel aperture.

* * * * *